US010968034B2

(12) United States Patent
Rodrigues

(10) Patent No.: US 10,968,034 B2
(45) Date of Patent: Apr. 6, 2021

(54) RESEALABLE CONTAINER INCLUDING EASY OPEN TAB

(71) Applicant: PHILIP MORRIS PRODUCTS S.A., Neuchatel (CH)

(72) Inventor: Luiz Andre Rodrigues, Neuchatel (CH)

(73) Assignee: PHILIP MORRIS PRODUCTS S.A., Neuchâtel (CH)

( * ) Notice: Subject to any disclaimer, the term of this patent is extended or adjusted under 35 U.S.C. 154(b) by 206 days.

(21) Appl. No.: 16/088,334

(22) PCT Filed: Mar. 15, 2017

(86) PCT No.: PCT/IB2017/051499
§ 371 (c)(1),
(2) Date: Sep. 25, 2018

(87) PCT Pub. No.: WO2017/168278
PCT Pub. Date: Oct. 5, 2017

(65) Prior Publication Data

US 2020/0039733 A1 Feb. 6, 2020

(30) Foreign Application Priority Data

Mar. 31, 2016 (EP) ..... 16163401

(51) Int. Cl.
*B65D 85/10* (2006.01)
*B65D 43/16* (2006.01)
(Continued)

(52) U.S. Cl.
CPC ..... *B65D 85/1036* (2013.01); *B65D 5/603* (2013.01); *B65D 5/662* (2013.01);
(Continued)

(58) Field of Classification Search
CPC ..... B65D 5/603; B65D 5/662; B65D 75/54; B65D 85/1036; B65D 5/422;
(Continued)

(56) References Cited

U.S. PATENT DOCUMENTS 4,300,676 A 11/1981 Frocke et al.
4,620,664 A * 11/1986 Kaufman ..... B65D 5/4233 206/459.5

(Continued)

FOREIGN PATENT DOCUMENTS

CN 101193808 A 6/2008
CN 201592852 U 9/2010

(Continued)

OTHER PUBLICATIONS

International Search Report and Written Opinion issued by the European Patent Office, for PCT/IB2017/051499, dated May 12, 2017; 11 pgs.

(Continued)

*Primary Examiner* — Gideon R Weinerth
(74) *Attorney, Agent, or Firm* — Mueting Raasch Group

(57) ABSTRACT

A container comprises a housing that comprises a box and a lid that is hingedly attached to the box. The lid comprises a bottom edge. The box comprises a front wall and a rear wall. The container also comprises an inner package disposed at least partially within the housing and at least partially defining an interior volume for housing consumer goods. The inner package is configured to open and close when the lid of the housing is opened and closed. The inner package comprises an access opening and a sealing flap. The sealing flap comprises a tab that has a bottom edge. The bottom edge of the tab is positioned below the bottom edge of the lid when the lid is in a closed position.

15 Claims, 3 Drawing Sheets

(51) Int. Cl.

| | |
|---|---|
| ***B65D 5/42*** | (2006.01) |
| ***B65D 5/60*** | (2006.01) |
| ***B65D 5/66*** | (2006.01) |
| *B65D 75/54* | (2006.01) |
| *A24F 15/00* | (2020.01) |
| *A24F 15/12* | (2006.01) |

(52) U.S. Cl.
CPC ..... *A24F 15/00* (2013.01); *A24F 15/12* (2013.01); *B65D 75/54* (2013.01); *B65D 85/10* (2013.01); *B65D 85/1027* (2013.01); *B65D 85/1045* (2013.01); *B65D 85/1081* (2013.01); *Y10S 206/831* (2013.01)

(58) Field of Classification Search
CPC .... B65D 5/4233; B65D 5/66; B65D 75/5838; B65D 85/1045; B65D 85/1027; B65D 85/1081; B65D 85/10; B65D 85/10568; B65D 85/1054; A24F 15/00; A24F 15/12; A24F 15/08; A24F 15/18; Y10S 206/831; Y10S 206/804
USPC ..... 206/268, 831, 232, 265, 242, 443
See application file for complete search history.

(56) References Cited

U.S. PATENT DOCUMENTS

| | | | | |
|---|---|---|---|---|
| 5,236,084 | A * | 8/1993 | Evers | B65D 5/422 206/273 |
| 5,363,955 | A * | 11/1994 | Fleenor | B65D 5/422 206/268 |
| 5,375,704 | A * | 12/1994 | Focke | B65D 85/1081 206/265 |
| 5,678,690 | A * | 10/1997 | Belvederi | B65D 85/1045 206/268 |
| 6,505,735 | B1 * | 1/2003 | Parker | B65D 75/5838 206/268 |
| 6,513,651 | B1 * | 2/2003 | Focke | B65D 85/1081 206/268 |
| 6,742,652 | B1 * | 6/2004 | Focke | B65D 85/1045 206/268 |
| 7,798,320 | B2 | 9/2010 | Pham | |
| 7,971,711 | B2 * | 7/2011 | Squarzoni | G09F 3/0288 206/242 |
| 8,474,612 | B2 * | 7/2013 | Bertuzzi | B65D 75/5838 206/264 |
| 9,089,165 | B2 * | 7/2015 | Bertuzzi | B65D 85/1045 |
| 10,112,762 | B2 * | 10/2018 | Tritz | B65D 85/1045 |
| 10,414,580 | B2 * | 9/2019 | Buse | B65D 85/1045 |
| D863,953 | S * | 10/2019 | Schnakenberg | D9/423 |
| 10,427,865 | B2 * | 10/2019 | Eggen | B65D 75/5838 |
| 10,457,461 | B2 * | 10/2019 | Dincer | B65D 5/54 |
| 10,494,168 | B2 * | 12/2019 | Bray | B65D 75/5838 |
| 10,661,975 | B2 * | 5/2020 | Slooff | B65D 85/1045 |
| 2006/0091025 | A1 * | 5/2006 | Focke | B65C 1/04 206/271 |
| 2007/0193896 | A1 | 8/2007 | Tanbo et al. | |
| 2010/0252462 | A1 | 10/2010 | Marchetti | |
| 2012/0006823 | A1 * | 1/2012 | Bertuzzi | B65D 85/1045 220/270 |
| 2012/0241339 | A1 * | 9/2012 | Buse | B65B 19/226 206/268 |
| 2014/0110286 | A1 * | 4/2014 | Bertuzzi | B65D 85/1045 206/268 |
| 2014/0374290 | A1 * | 12/2014 | Seyfferth De Oliveira | B65D 5/6602 206/268 |
| 2015/0021219 | A1 * | 1/2015 | Seyfferth De Oliveira | B65D 85/1045 206/268 |
| 2015/0027916 | A1 * | 1/2015 | Buse | B65B 19/025 206/268 |
| 2015/0034508 | A1 * | 2/2015 | Lutzig | B65D 85/1045 206/268 |
| 2015/0034509 | A1 * | 2/2015 | Seyfferth De Oliveira | B65D 85/1045 206/268 |
| 2015/0041346 | A1 | 2/2015 | Seyfferth de Oliveria | |
| 2015/0320111 | A1 * | 11/2015 | Slooff | A24F 15/12 206/242 |
| 2015/0321831 | A1 * | 11/2015 | Ghini | B65D 85/1045 206/268 |
| 2016/0236855 | A1 * | 8/2016 | Chatelain | B65C 3/08 |
| 2016/0368645 | A1 * | 12/2016 | Buse | B65B 19/221 |
| 2017/0088341 | A1 * | 3/2017 | Fallon | A24F 15/00 |
| 2017/0197778 | A1 * | 7/2017 | Slooff | B65D 77/04 |
| 2017/0203910 | A1 * | 7/2017 | Buse | B65D 85/1045 |
| 2017/0349365 | A1 * | 12/2017 | Hill | B65D 85/1045 |
| 2018/0162631 | A1 * | 6/2018 | Bray | B65D 85/1018 |
| 2018/0305112 | A1 * | 10/2018 | Slooff | B65D 5/4233 |
| 2018/0305113 | A1 * | 10/2018 | Slooff | B65D 85/1045 |
| 2018/0319576 | A1 * | 11/2018 | Draghetti | B65D 85/1081 |
| 2018/0334317 | A1 * | 11/2018 | Slooff | B65D 85/1045 |
| 2018/0346235 | A1 * | 12/2018 | Buse | B65D 85/1045 |
| 2018/0362247 | A1 * | 12/2018 | Slooff | B65D 85/1045 |
| 2019/0218021 | A1 * | 7/2019 | Buse | B65B 61/065 |
| 2019/0263556 | A1 * | 8/2019 | Cailleaux | B32B 7/04 |
| 2019/0352041 | A1 * | 11/2019 | Polloni | B65D 5/0227 |
| 2020/0039733 | A1 * | 2/2020 | Rodrigues | B65D 5/603 |
| 2020/0290794 | A1 * | 9/2020 | Collins | B65D 85/1045 |

FOREIGN PATENT DOCUMENTS

| | | | |
|---|---|---|---|
| CN | 204979789 | U | 1/2016 |
| DE | 10 2014 011396 | A1 | 2/2016 |
| EP | 2 471 725 | A1 | 7/2012 |
| RU | 2357906 | C2 | 10/2009 |
| WO | WO 2015/059655 | A1 | 4/2015 |

OTHER PUBLICATIONS

International Preliminary Report on Patentability issued by the European Patent Office, for PCT/IB2017/051499, dated Mar. 16, 2018; 13 pgs.
Extended EP Search Report issued by the European Patent Office for EP 16163401.9, dated Sep. 16, 2016; 6 pgs.
Chinese First Office Action issued by the China National Intellectual Property Administration on Sep. 2, 2019 for CN Application No. 201780015517.X; 15 pages including English Translation.
Russian Decision to Grant and Search Report issued by the Russian Patent Office for RU 2018138153; 17 pgs. Including English Translation.

* cited by examiner

RESEALABLE CONTAINER INCLUDING EASY OPEN TAB

This application is the § 371 U.S. National Stage of International Application No. PCT/IB2017/051499, filed 15 Mar. 2017, which claims the benefit of European Application No. 16163401.9, filed 31 Mar. 2016, the disclosures of which are incorporated by reference herein in their entireties.

The present invention relates to a resealable container for consumer goods that includes a tab that remains exposed after opening the container. The container finds particular application as a container for elongate smoking articles such as cigarettes.

Resealable containers are commonly utilized to contain consumer goods, such as smoking articles, such as cigarettes.

U.S. Pat. No. 4,300,676 discloses a consumer goods container that includes a tab for opening the container, but the container itself is not resealable and the tab only provides assistance in the initial opening of the container because it resides underneath the lid upon closing. Therefore, such resealable containers can be difficult to open after the initial opening.

One object of the invention is to provide a container that affords automatic opening and resealing of an inside sealed package upon opening the outer lid and easier re-opening of the container. It is another objective of the invention to provide an additional information carrier, such as an insert with such a container.

In one aspect of the present invention, a container is described. The container comprises a housing that comprises a box and a lid that is hingedly attached to the box. The lid comprises a bottom edge. The box comprises a front wall and a rear wall. The container also comprises an inner package disposed at least partially within the housing and at least partially defining an interior volume for housing consumer goods. The inner package is configured to open and close when the lid of the housing is opened and closed. The inner package comprises an access opening and a sealing flap. The sealing flap comprises a tab that has a bottom edge. The bottom edge of the tab is positioned below the bottom edge of the lid when the lid is in a closed position.

In other aspects of the present invention, the tab is inside the housing before the container is initially opened and outside the housing after the container has been initially opened.

Various aspects of the present invention may provide one or more advantages relative to currently—available or previously—described containers. For example, inclusion of the tab allows more of the inner package to become the access opening, thereby making it bigger while still affording a container that is relatively easy to open because of the tab. The tab may also provide leverage for opening the container after the initial opening of the container. Tabs of the invention can be utilized with both a two layer inner package where the tab is part of the inner package or an inner package that is sealed with an applied label where the tab is part of the label.

An additional information carrier can also be coupled to the tab without affecting initial opening of the container or decreasing the ease of later openings.

The present invention is applicable to any suitable container for consumer goods such as for example elongate smoking articles. It is known to package consumer goods such as, for example, elongate smoking articles in containers formed from folded laminar blanks. For example, elongate smoking articles, such as cigarettes and cigars, are commonly sold in hinge lid packs having a box for housing the smoking articles and a lid connected to the box about a hinge line extending across the back wall of the container.

The container may take any suitable form for housing consumer goods. For example, as already mentioned, the container may comprise a housing that can be described as a hinge-lid container having one or more hinged lids connected to a box housing the consumer goods. In one or more embodiments, the container may be a slide and shell container having an inner slide for housing the consumer goods mounted within an outer shell. Where the container is a slide and shell container, the outer shell or the inner slide may include one or more hinge lids. The container may be formed from any suitable materials including, but not limited to, cardboard, paperboard, plastic, metal, other materials, or combinations thereof. The cardboard may have a weight of between about 100 grams per square meter and about 350 grams per square meter.

Containers described herein will generally have the same or a similar shape as the housing. As such, housings according to the invention may be in the shape of a rectangular parallelepiped, with right-angled longitudinal and right-angled transverse edges. Alternatively, the housing may comprise one or more rounded longitudinal edges, rounded transverse edges, bevelled longitudinal edges, or bevelled transverse edges, other types of edges, or combinations thereof.

Containers according to the invention find particular application as packs for elongate smoking articles such as, for example, cigarettes, cigars or cigarillos. In other embodiments, the consumer goods may be aerosol-generating articles such as articles that heat but not burn tobacco. It will be appreciated that through appropriate choices of the dimensions thereof, containers according to the invention may be designed for different numbers of conventional size, king size, super-king size, slim or super-slim cigarettes. Through an appropriate choice of the dimensions thereof, containers or housings according to the invention may be designed to hold different total numbers of smoking articles, or different arrangements of smoking articles. For example, through an appropriate choice of the dimensions thereof, containers or housings according to the invention may be designed to hold a total of between ten and thirty smoking articles.

As well as housing a bundle of smoking articles, in some embodiments the container may further comprise other consumer goods, for example, matches, lighters, extinguishing means, breath-fresheners, or electronics. The other consumer goods may be attached to the outside of the container, contained within the container along with the smoking articles, in a separate compartment of the container, or any combination thereof.

Disclosed containers comprise a housing. The housing has an inner surface and an outer surface. The housing also has a rear wall, a front wall and two side walls. The housing comprises a lid and a box.

The lid of the housing is hingedly attached to the box and is adapted to be manipulated between an open position and a closed position. In the open position, the consumer can access the consumer goods disposed within the housing. The lid is hingedly attached to the box along a hinge line that extends across the rear wall or the upper edge of the rear wall of the box of the housing. A hinge line may be, for example, a fold line or a score line in the panel forming the back wall of the housing. The lid and box are further defined by an opening line. The opening line refers to the delineation between the lid and the box which begins at one end of the hinge line traverses the right side of the housing, the front of the housing then the left side of the housing, or vice versa, and ends at the other end of the hinge line.

Preferably, the lid comprises a lid front wall, a lid left side wall, a lid right side wall, a lid back wall, and a lid top wall. The lid has an inner surface and an outer surface. The front wall of the lid also has a bottom edge.

Preferably, the box comprises a box front wall, a box left side wall, a box right side wall, a box back wall, and a box bottom wall. The box has an inner surface and an outer surface. In preferred embodiments, the front wall of the box has an upper edge, which when closed at least partially meets the bottom edge of the lid.

The container also comprises an inner package. The inner package is disposed within the housing of the container. The inner package can be configured to house or hold consumer goods. Illustrative consumer goods can include smoking articles such as elongate smoking articles. Specific exemplary elongate smoking articles can include for example cigarettes, cigars, cigarillos consumer goods such as aerosol-generating articles that heat but not burn tobacco, or combinations thereof.

The inner package can be made of any suitable materials, for example, polymeric materials, metal foils, other materials, or combinations thereof. The inner package preferably comprises polymeric materials such as polyethylene films, polyolefin films, poly lactic acid (PLA) films, or some combination thereof. Preferably, the inner package can comprise a first layer and a second layer that are attached, at least at their peripheries to form a package with an interior volume.

The inner package comprises an access opening that affords access to the consumer goods housed inside when the inner package is opened. The inner package also includes a flap that covers the access opening when the container and the flap are in a closed position. The access opening is at least partially uncovered when the container and the flap are in the open position. The access opening can be cut during manufacturing, for example. Preferably, the flap forms an S-shape, a curve with at least two turning points when the flap is open.

In some preferred embodiments, the access opening can be defined by lines of weakness that are cut in both the first layer and the second layer of the inner package. The second layer (for example, the internal layer) can have a line of weakness that is inside the line of weakness cut in the first layer (for example, the external layer) in order to form an access opening that is large enough to allow access to the consumer articles in the inner package.

Lines of weakness, whether in the inner package or elsewhere, can be formed using any available methods. Preferably, lines of weakness can be formed by mechanical cutting; by use of a laser; by degrading a portion of the material using ultraviolet (UV) energy, infrared (IR) energy, Gamma energy, X-ray energy, chemical treatment, thermal treatment, galvanic treatment, other treatments, or any combination thereof; or any combination thereof.

A line of weakness need not be continuous, and can for example include an offset portion. A line of weakness can also have different depths at different points. A line of weakness can also be described by the force necessary to break the inner package and form the access opening at the line of weakness, for example. Preferably, a line of weakness, whether the line of weakness is a cut, slit or perforation, may require a force not greater than about 12 Newtons to break, preferably, the force is smaller than 6 Newtons to break, more preferably, the force is smaller than 3 Newtons to break.

The inner package also comprises a flap. Preferably, the first layer of a multilayer inner package comprises a flap. In some preferred embodiments, the flap can be attached to the inner surface of the lid, via adhesive, or otherwise. In some embodiments, the flap can be attached to the inner surface of the lid with a label comprising one or more adhesive portions.

In some embodiments, the inner package, or preferably the flap comprises or can be coupled to a resealable label. The resealable label can be configured to attach the flap to the inner surface of the lid as well as reseal the inner package. In such an embodiment, when opening the lid and the inner package, a portion of the second layer attached to the flap, the sealing region, are separated from each other along first and second cut lines respectively to reveal the access opening. The resealable label can be attached to the lid using any suitable techniques, for example, mechanical attachment, adhesive, thermal, or ultrasonic bonding. Preferably, the resealable label can be attached to the lid using an adhesive, more preferably a permanent adhesive. The resealable label can be configured to be re-attached to the second layer when the flap and the lid of the container are in the closed position.

The resealable label allows for repeated opening and closing of the inner package to access the consumer goods individually. The resealable label preferably provides sufficient adhesion for the flap to be re-attached at least as many times as there are consumer goods within the inner package. The resealable label preferably enables a consumer to open and reseal the inner package until the package is empty.

The resealable label has an inner surface and an outer surface. The outer surface of the resealable label can be configured to permanently attach the label and in some embodiments the flap of the inner package to the inner surface of the front wall of the lid.

In some preferred embodiments, the inner surface of the resealable label can comprise at least a resealable adhesive area and a non-adhesive portion. The resealable adhesive area can be such that movement of the lid between open and closed positions simultaneously moves the flap and the access opening of the inner package between opened and closed positions. In the closed position, the flap and label cover the access opening of the inner package and is resealably attached to the inner package by the resealable adhesive area. In the open position, the flap and label are at least partially detached from the inner package and the access opening of the inner package is at least partially uncovered or opened. The resealable adhesive area of the label can utilize an adhesive for example, preferably a pressure sensitive adhesive. The resealable adhesive area can include adhesive on an upper portion of the flap, a lower portion of the flap, or both.

In some preferred embodiments, the resealable adhesive area is positioned around the periphery of the access opening. The resealable adhesive generally has a configuration and dimensions such that the inner package can maintain a sufficient seal once resealed. Preferably, the resealable adhesive area has vertical regions, horizontal regions and transition regions between the two. The horizontal regions are those regions that are generally substantially parallel to the bottom of the box. The vertical regions are those regions that are generally perpendicular to the bottom of the box or generally perpendicular to the horizontal regions. The transition regions are the regions that connect the horizontal regions and the vertical regions. The transition regions can also be described as an arc that connects the horizontal regions and vertical regions. Preferably, the vertical regions can have a width of at least 2 mm. Preferably, the horizontal region adjacent the tab can have a height, measured along an axis from the top to the bottom (or vice versa) of the container that is between about 2 mm to about 10 mm, or more preferably at least about 3 mm, or at least about 4 mm. Preferably, the transition regions can have a thickness that is at least about 1 mm.

The sealing flap of the inner package also includes a tab. The tab can be the same material or a different material than the sealing flap. Preferably, the tab is positioned below the sealing flap when the container is in a closed position. Preferably, the tab does not contact the resealable adhesive area when the box is properly closed, as it is positioned below the resealable adhesive area. The tab can preferably be defined by the first cut layer in the first layer (for example, the external layer) of the inner package. Preferably, the tab can be described as having a width (parallel to the bottom of the box) that is less than the width of the access opening. The tab has a bottom edge that is positioned below the bottom edge of the lid when the lid is closed. Preferably, before the container has been opened for the first time, the tab is below the upper edge of the front wall and inside the housing and once the container has been initially opened, the tab can be positioned either inside or outside the housing. Preferably, the tab is positioned outside the housing once the container has been initially opened. Positioning of the tab outside the housing can provide a pull tab for easier subsequent opening of the container.

The tab can be described by its height, along an axis from the top to the bottom of the container or housing. Preferably, the tab can have a height between about 2 mm and about 25 mm, or even more preferably between about 8 mm and about 20 mm.

The container can also optionally comprise an additional information carrier. The information carrier can be utilized for communication. The information carrier can comprise or be made of any suitable materials. For example, the information carrier can comprise cardboard, paperboard, paper, plastic, metal, or combinations thereof. The information carrier can be printed thereon for example using any known printing techniques. The information carrier can be folded in order to increase the available communication space. The information carrier can be folded longitudinally or transversally or both longitudinally and transversally. Preferably, at least one dimension of the information carrier (whether in total or once folded), for example, the height of the information carrier, can be less than the height of the front wall of the box. Such configurations afford the use of the maximum length of the information carrier. Preferably, the other dimension of the information carrier (whether in total or once folded), for example the width of the information carrier, can be less than the width of the front of the box. Because of the ability to fold the information carrier once, twice, or more often the overall surface of the information carrier can be increased.

The information carrier can be coupled to the tab. Preferably, the information carrier can be coupled to at least the bottom edge of the tab. In some embodiments, the information carrier can also be coupled to the bottom edge and sides of the tab. In some embodiments the information carrier can be coupled to only the bottom edge of the tab or to the bottom edge of the tab as well as to additional portions of the tab, the inner package, or both.

The information carrier can be coupled to the tab in a number of ways. The information carrier can be coupled to the tab by being extensive with the tab, being adhered to the tab, or combinations thereof. Preferably, the information carrier is extensive with the tab. Even more preferably, the information carrier can include the same material as the tab and can be extensive with the tab. In some embodiments, the information carrier could also be the same or a different material than the tab and be laminated to the tab.

In some embodiments, the information carrier can include or be coupled to the tab via a line of weakness or perforation. Alternatively, the information carrier can be coupled to the tab by lamination and can be removed by delaminating, for example. Preferably, the information carrier is coupled to the tab via a line of weakness. The information carrier can then be removed from the tab by tearing or breaking the line of weakness.

The information carrier can optionally be temporarily or releasably attached to the box or a liner over the box before opening the container. For example, the information carrier can be temporarily or releasably attached to the box or a liner over the box with adhesive. Upon initial opening of the container, the information carrier automatically moves away from the box of the container, making it easier to remove the information carrier from the tab. The information carrier, can be made more easily accessible once the box is opened, because as the tab is lifted away from the box the information carrier is also moved away from the box.

In some embodiments, the container can also comprise an optional inner frame disposed within the box. The inner frame can be disposed inside the front wall of the box. Advantageously, an inner frame with a large surface area provided adjacent the front wall of the box increases the structural strength of the container. This is particularly advantageous for subsequent use when the container is no longer full. A container can also optionally include an inner liner. The inner liner can wrap the consumer goods. The inner liner and the consumer goods can collectively be referred to as an inner package. A carton that includes a lid and at least one sidewall can contain multiple containers as described herein.

Containers of the present invention function to afford a resealable package that includes a tab for ease of opening after the initial opening. Information carriers can also be combined with the tab in order to communication additional information, which can optionally be removed from the container via a line of weakness between the information carrier and the tab.

The term "inner surface" is used throughout the specification to refer to the surface of a component of the assembled container that is facing towards the interior of the container, for example towards the consumer goods, when the container is in the closed position. For example, the outer film comprises an inner surface that is facing the housing of the container.

The term "outer surface" is used throughout the specification to refer to the surface of a component of the container that is facing towards the exterior of the container. For example, the outer film comprises an outer surface that is facing away from the housing of the container. It should be noted that the inside or outside surface is not necessarily equivalent to a certain side of a blank used in assembly of the container. Depending on how the blank is folded around the consumer goods, areas that are on the same side of the container can either face towards the inside or the towards the outside of the container.

The terms "front," "back," "upper," "lower," "top," "bottom," and "side" refer to the relative positions of portions of containers according to the invention and components thereof when the container is in an upright position with the lid of the housing in the closed position and the hinge line at the rear of the container. When describing containers according to the present invention, these terms are used irrespective of the orientation of the container being described. The rear or back wall of the container includes the hinge line.

Referring now to the drawings, in which some aspects of the present invention are illustrated.

Figure 1:
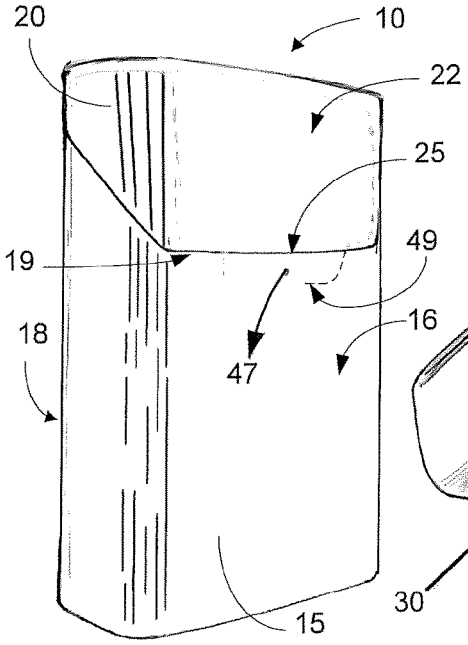
FIG. 1 is a schematic perspective view of a container in an closed position, where the container comprises a tab under the box of the container.
Figure 2:
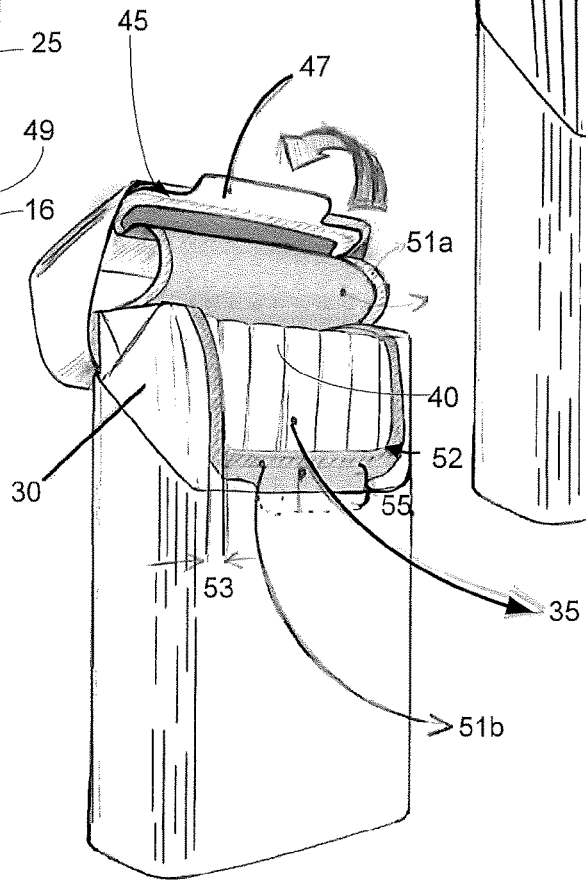
FIG. 2 is a schematic perspective view of the container of FIG. 1, once opened.
Figure 3:
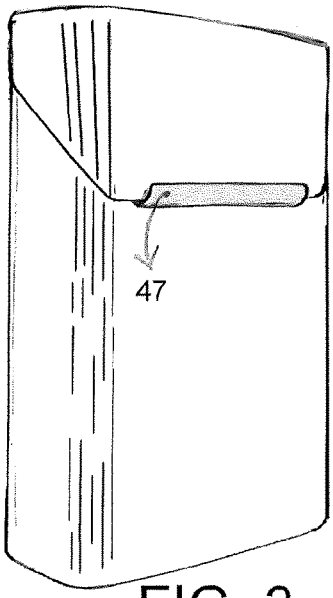
FIG. 3 is a schematic perspective view of the container of FIGS. 1 and 2, once closed showing the tab on the outside of the box of the housing.

FIGS. 1, 2 and 3 depict an illustrative container before opening (FIG. 1), opened (FIG. 2), and after being closed (FIG. 3). The container 10 includes a housing that includes a box 15 and a lid 20. The box 15 has a front wall 16 and a real wall 18. The front wall 16 of the box has an upper edge 19. The lid 20 is hingedly attached to the box 15 along a hinge line extending across a rear wall of the container (not shown in FIG. 1, 2 or 3). The lid is hingedly attached and can be in a closed position and an opened position. The lid has a front wall 22 and an opposing rear wall. The front wall 22 of the lid 20 has a bottom edge 25. When the container is in the closed position, the bottom edge 25 of the lid and the upper edge 19 of the box are adjacent each other.

The container also includes an inner package, seen in FIG. 2. The inner package 30 is disposed within the housing and at least partially defines an interior volume for consumer goods 35. The inner package is made from a barrier material or materials to hermetically seal the consumer goods before the container is opened for the first time. The barrier material may be a metal foil or a plastic and metal laminate. The inner package 30 can include a front wall and a back wall, as well as an outer surface and an inner surface. The inner package 30 may be made of a first layer and a second layer attached to an inner surface of the first layer.

The inner package 30 includes an access opening 40 through which the consumer goods can be removed. The access opening 40 is covered by a sealing flap 45 when the flap is in the closed position (FIGS. 1 and 3). Further, the access opening 40 is at least partially uncovered with the flap 45 in the open position (FIG. 2). The inner package 30, through the access opening 40 and the flap 45, is configured to open and close when the lid 20 of the housing is opened and closed (opening action depicted by the arrow in FIG. 2). The flap 45 can be made up of the outer film of a two film inner package, a resealable label, releasable adhesive, or any combination thereof.

The sealing flap 45 includes a tab 47, specifically denoted in FIG. 1, but visible in all figures. The tab 47 has a bottom edge 49 that is positioned below the bottom edge 25 of the lid 20 when the lid 20 is closed, as seen in FIG. 1. As seen in FIG. 1, the bottom edge 49 of the tab 47 can be inside the housing of the container before the container is initially opened (indicated by dashed line) and as seen in FIG. 3, resides outside the container 10 after the container is initially opened even after being closed. The tab 47 can have a height 55, as measured from below the resealable adhesive to the bottom edge 49 of the tab that is between about 2 mm and about 25 mm, or more preferably between about 8 mm and about 20 mm Referring to FIG. 1, where the inner package includes a first layer and a second layer attached to the inner surface of the first layer, the first layer can include a line of weakness that defines the sealing flap and the tab. The sealing flap 45 can further include a releasable adhesive area 51. The tab 47 does not contact the adhesive area 51 even when the box is closed, as it is positioned below the releasable adhesive area 51. The releasable adhesive area 51 is positioned around the periphery of the access opening 40. The releasable adhesive area 51 can include adhesive on the upper portion 51*a* of the flap, on the lower portion 51*b* of the flap, or on both.

The releasable adhesive area 51 has vertical regions and horizontal regions (where the vertical regions are substantially in a plane along the top to the bottom of the container and the horizontal regions are in a plane parallel to the bottom of the container or box). The vertical regions can have a width, as seen in FIG. 2 as 53 that is at least about 2 mm. The region of the releasable adhesive area 51 that forms the transition 52 from a horizontal region to a vertical region (or vice versa) can have a thickness of at least about 1 mm. The horizontal region, for example the horizontal region of the resealable adhesive that is between the access opening and the tab can have a height, along an axis from the top to the bottom of the box or container that is from about 2 mm to about 10 mm.

Figure 4:
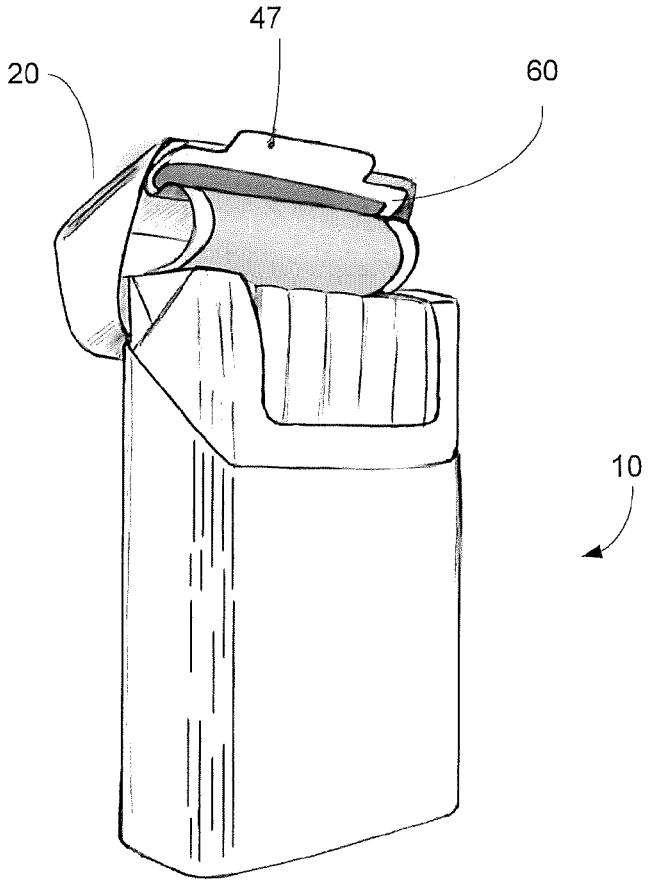
FIG. 4 is a schematic perspective view of a container that includes a resealable label as a portion of a sealing flap that includes a tab in an open position.

FIG. 4 depicts a container that includes a resealable label as a portion of a sealing flap. The resealable label 60 functions to open and close the inner package of the container 10 when the lid 20 is open and closed. The inner package also includes a tab 47 that extends beyond the resealable label 60 even when the resealable label has sealed the inner package once the container has been closed. The tab 47, once the container is initially opened exists outside the housing (similar to FIG. 3), to afford a pull tab to allow for an easier access to the container.

Figure 5:
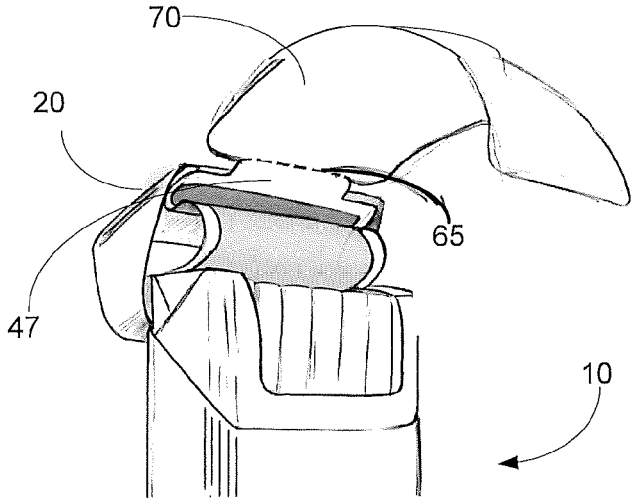
FIG. 5 is a schematic perspective view of a container in an open position that includes an information carrier associated with a tab.

FIG. 5 depicts a container that includes an optional information carrier. The container 10 includes a lid 20 and an inner package including a tab 47. Coupled to the tab 47 is an information carrier 70, The information carrier 70 in this specific example is coupled only to the bottom edge of the tab 47. The information carrier 70 can be made of any useful material, can have any useful dimensions, and can optionally be folded either transversally or longitudinally or both longitudinally and transversally. The information carrier 70 can be extensive with the tab, laminated to the tab, adhered to the tab, or otherwise. The information carrier is coupled to the tab 47 via a line of weakness 65 in this specific container. Upon initial opening of the container 10, the lid 20 moves about the hinge line and the information carrier, because it is coupled to the tab, automatically moves away from the housing of the container. The line of weakness 65 can then be broken to remove the information carrier 70 from the container 10. The tab 47 then remains outside the housing of the container once the container is closed, thereby sealing the inner package (similar to FIG. 3).

Figure 6:
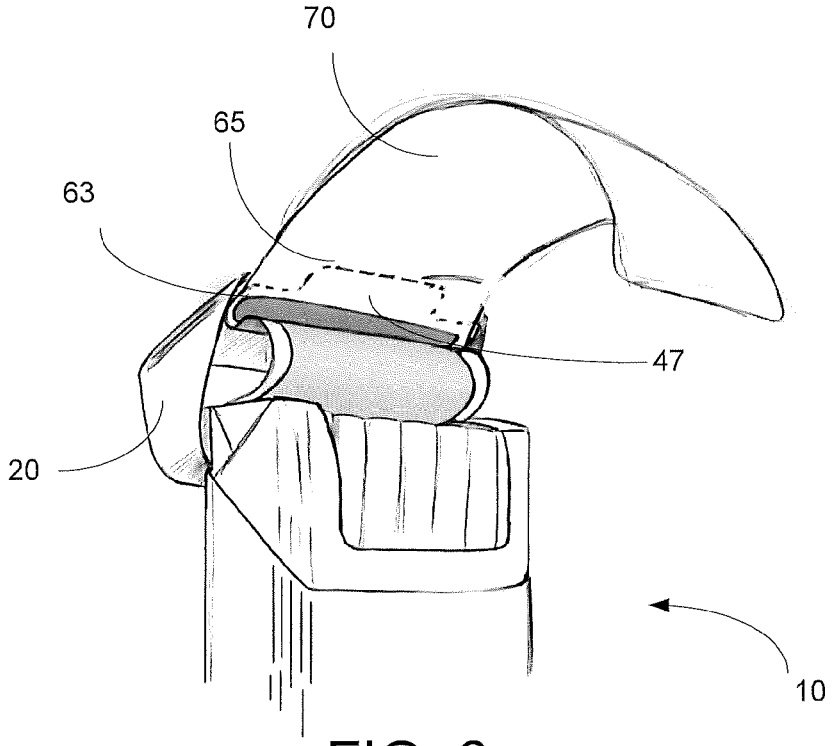
FIG. 6 is a schematic perspective view of a container in an open position that includes an information carrier associated with a tab and a label.

FIG. 6 depicts another container that includes an optional information carrier. The container 10 includes a lid 20 and an inner package including a tab 47. Coupled to the tab 47 is an information carrier 70. The information carrier 70 in this specific example is coupled to the bottom edge of the tab as well as to the exposed sides 63 of the tab 47. The line of weakness 65 forms the entire periphery of the tab 47 and a portion of the sealing flap. Once the container is initially opened, the information carrier automatically moves away from the housing of the container. The line of weakness 65 can be broken, liberating the information carrier from the container. Breaking the line of weakness 65 also defines the tab 47, which can then be utilized to assist in subsequent opening of the container.

The invention claimed is:

1. A container for consumer goods, comprising:

a housing comprising a box and a lid hingedly attached to the box, wherein the box comprises a front wall, a rear wall and the lid comprises a bottom edge;

an inner package disposed within the housing and at least partially defining an interior volume for housing consumer goods, the inner package comprising an access opening and a sealing flap, the inner package configured to open and close when the lid of the housing is opened and closed, the sealing flap comprising a tab, the tab comprising a bottom edge, wherein the bottom edge of the tab is positioned below the bottom edge of the lid and below the upper edge of the front wall when the lid is closed, and an information carrier coupled to the bottom edge of the tab.

2. The container according to claim 1, wherein the inner package comprises a first layer and a second layer attached to an inner surface of the first layer.

3. The container according to claim 2, wherein the first layer comprises a line of weakness that defines the sealing flap and the tab.

4. The container according to claim 1, wherein the sealing flap further comprises a releasable adhesive and wherein the tab is adhesive free.

5. The container according to claim 4, wherein the releasable adhesive between the opening and the tab has a height of between about 2 mm and about 10 mm.

6. The container according to claim 1, wherein the sealing flap comprises a resealable label configured to open and close the inner package when the lid of the housing is opened and closed.

7. The container according to claim 6, wherein the resealable label has an outer surface and an inner surface and the inner surface comprises a releasable adhesive and the tab is positioned below the releasable adhesive.

8. The container according to claim 7, wherein the releasable adhesive between the opening and the tab has a height of between about 2 mm and about 10 mm.

9. The container according to claim 1, wherein the tab has a height of between about 2 mm and about 25 mm.

10. The container according to claim 1, wherein opening the container automatically moves the information carrier away from the housing of the container.

11. The container according to claim 1, wherein the tab is positioned at least partially outside the box after initially opening the container.

12. The container according to claim 1, wherein the tab provides leverage for opening the lid of the container after initially opening the container.

13. The container according to claim 1 further comprising the consumer goods, wherein the consumer goods are housed in the interior volume defined by the inner package.

14. The container according to claim 1, wherein the consumer goods are smoking articles.

15. A carton comprising more than one container according to claim 1.

* * * * *